US011047639B2

(12) United States Patent
Macy

(10) Patent No.: US 11,047,639 B2
(45) Date of Patent: Jun. 29, 2021

(54) METHOD AND GRIP MODULE FOR FIREARM MODIFICATION USING A FIRING CONTROL UNIT

(71) Applicant: Black Site, Inc., Houston, TX (US)

(72) Inventor: Omar Alonso Macy, Houston, TX (US)

(73) Assignee: Black Site, Inc., Houston, TX (US)

( * ) Notice: Subject to any disclaimer, the term of this patent is extended or adjusted under 35 U.S.C. 154(b) by 0 days.

(21) Appl. No.: 15/900,524

(22) Filed: Feb. 20, 2018

(65) Prior Publication Data

US 2018/0224233 A1 Aug. 9, 2018

Related U.S. Application Data

(63) Continuation-in-part of application No. 15/892,397, filed on Feb. 8, 2018, now abandoned, and a (Continued)

(51) Int. Cl.
*F41A 19/12* (2006.01)
*F41A 19/10* (2006.01)

(Continued)

(52) U.S. Cl.
CPC ..... *F41A 19/12* (2013.01); *F41A 11/02* (2013.01); *F41A 19/10* (2013.01); *F41A 19/31* (2013.01);

(Continued)

(58) Field of Classification Search
CPC ..... F41A 19/10; F41A 19/12; F41A 19/15; F41A 19/31; F41A 11/02; F41C 23/12; F41C 23/22; F41C 27/22

(Continued)

(56) References Cited

U.S. PATENT DOCUMENTS 3,507,067 A † 4/1970 Into
4,463,654 A * 8/1984 Barnes ..... F41A 19/09 42/74

(Continued)

FOREIGN PATENT DOCUMENTS

EP 1998134 A2 † 12/2008
WO 2015016026 A1 † 7/2015
WO 2016025534 A1 † 2/2016

OTHER PUBLICATIONS

Nick Leghorn, Honor Defense Honor Guard HG9SC review, May 13, 2016, The Truth About Guns (internet publication), pp. 1-11. (Year: 2016).*

(Continued)

*Primary Examiner* — Bret Hayes
(74) *Attorney, Agent, or Firm* — James M. Wu; JW Law Group

(57) ABSTRACT

A bullpup-shaped rifle ("BSR") or assault rifle ("AR") able to expel a bullet is disclosed. In some embodiments, the BSR includes a firing control unit ("FCU"), grip module, bullpup rear attachment, and bolt and barrel assembly. The FCU is a serialized trigger mechanism capable of initiating launching a directional object when a trigger of the FCU is pulled. The grip module which contains a grip, FCU housing, and rear stabilizing connector, wherein the FCU housing is configured to house a removable FCU. The bullpup rear attachment which is coupled to the rear stabilizing connector for enhancing stability is configured to have a magazine port for receiving a magazine. The bolt and barrel assembly which is situated above the magazine port inside of the bullpup rear attachment behind the FCU facilitates the firing of the object.

27 Claims, 11 Drawing Sheets

Related U.S. Application Data continuation of application No. 15/892,410, filed on Feb. 9, 2018, now abandoned.

(60) Provisional application No. 62/456,490, filed on Feb. 8, 2017, provisional application No. 62/456,499, filed on Feb. 8, 2017.

(51) Int. Cl.

| | |
|---|---|
| ***F41A 19/31*** | (2006.01) |
| ***F41C 23/12*** | (2006.01) |
| ***F41A 11/02*** | (2006.01) |
| *F41C 23/22* | (2006.01) |
| *F41A 19/15* | (2006.01) |
| *F41C 27/22* | (2006.01) |

(52) U.S. Cl.
CPC ..... *F41C 23/12* (2013.01); *F41A 19/15* (2013.01); *F41C 23/22* (2013.01); *F41C 27/22* (2013.01)

(58) Field of Classification Search
USPC ..... 42/69.01, 69.02, 69.03
See application file for complete search history.

(56) References Cited

U.S. PATENT DOCUMENTS

| | | | | |
|---|---|---|---|---|
| 4,693,170 | A † | 9/1987 | Atchisson | |
| 7,841,121 | B1 * | 11/2010 | Barrett | F41A 11/04 42/75.02 |
| D693,420 | S * | 11/2013 | Abbott | F41A 11/02 D22/103 |
| 9,057,577 | B2 † | 6/2015 | Hannan | |
| 9,303,936 | B2 | 4/2016 | Toner | |
| 9,310,150 | B1 † | 4/2016 | Geissele | |
| 9,658,015 | B2 † | 5/2017 | Alicea | |
| 9,823,031 | B2 † | 11/2017 | Robbins | |
| 2006/0048424 | A1 * | 3/2006 | Weir | F41A 19/00 42/69.01 |
| 2008/0105245 | A1 † | 5/2008 | Cole | |
| 2009/0071053 | A1 | 3/2009 | Thomele et al. | |
| 2014/0075803 | A1 * | 3/2014 | Muller | F41A 11/02 42/16 |
| 2015/0253095 | A1 * | 9/2015 | Wilson | F41A 19/10 42/69.01 |
| 2015/0316339 | A1 * | 11/2015 | Young | F41A 11/02 42/49.01 |
| 2016/0153744 | A1 † | 6/2016 | Teetzel | |
| 2017/0167812 | A1 * | 6/2017 | Shaver | F41A 11/02 |
| 2018/0100712 | A1 * | 4/2018 | Tompkins | F41A 3/66 |
| 2018/0195822 | A1 * | 7/2018 | Jonsson | F41A 11/02 |

OTHER PUBLICATIONS

Nick Leghorn, Honor Defense Honor Guard HG9SC review, May 13, 2016, The Truth About Guns (internet publication), full picture (close up) of the Honor Guard serialized chassis. (Year: 2016).*

Author Unknown, New Beretta Nano Pistol Features Modular Serialized Chassis, Sep. 27, 2011, Daily Bulletin (internet publication), pp. 1-5 (Year: 2011).*

* cited by examiner
† cited by third party

METHOD AND GRIP MODULE FOR FIREARM MODIFICATION USING A FIRING CONTROL UNIT

PRIORITY

This application is a continuation-in-part of U.S. patent application Ser. No. 15/892,397, filed on Feb. 8, 2018 in the name of the same inventor and entitled "Method and Apparatus for Providing a Grip Module able to House a Firing Control Unit," which further claims the benefit of priority based upon U.S. Provisional Patent Application Ser. No. 62/456,490, filed on Feb. 8, 2017 in the name of the same inventor and entitled "Firearm Grip Module," and U.S. Provisional Patent Application Ser. No. 62/456,499, filed on Feb. 8, 2017 in the name of the same inventor and entitled "Firearm Grip Module Conversion," and this application is also a continuation-in-part of U.S. patent application Ser. No. 15/892,410, filed on Feb. 9, 2018 in the name of the same inventor and entitled "Method and Grip Module for Firearm Modification Using a Firing Control Unit," all of which are incorporated herein by reference in their entirety.

FIELD

The embodiments of present invention relate to firearms. More specifically, the present invention relates to receivers of guns.

BACKGROUND

A conventional gun, such as a rifle and/or pistol containing a striker is able to strike the casing of the ammunition to ignite the primer and discharge the projectile. For example, when a trigger of pistol is pulled, the sear releases the striker, allowing the striker spring to displace the striker forward so that the striker strikes the ammunition to launch a bullet. Typically, the guns include different types of firearms which include, but not limited to, semiautomatic rifles (i.e., Ruger SR-556, Smith & Wesson M&P15-22, CMMG Mk47 Mutant), bullpup firearms (i.e., Kel-Tec KSG, Kel-Tec RDB, M17S556), and/or machine guns (i.e., TEC 9, NP9, Honey Badger PDW).

A problem associated with the conventional guns is that the components of the different types of the guns are not interchangeable.

SUMMARY

A bullpup-shaped rifle ("BSR") or assault rifle ("AR") able to expel a bullet is disclosed. In some embodiments, the BSR includes a firing control unit ("FCU"), grip module, bullpup rear attachment, and bolt and barrel assembly. The FCU is a serialized trigger mechanism capable of initiating launching a directional object when a trigger of the FCU is pulled. The grip module which contains a grip, FCU housing, and rear stabilizing connector, wherein the FCU housing is configured to house a removable FCU. The bullpup rear attachment which is coupled to the rear stabilizing connector for enhancing stability is configured to have a magazine port for receiving a magazine. The bolt and barrel assembly which is situated above the magazine port inside of the bullpup rear attachment behind the FCU facilitates the firing of the object. In one aspect, the BSR also includes an upper receiver configured to couple to the grip module for enclosing the FCU and the bolt and barrel assembly between the upper receiver and the grip module.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
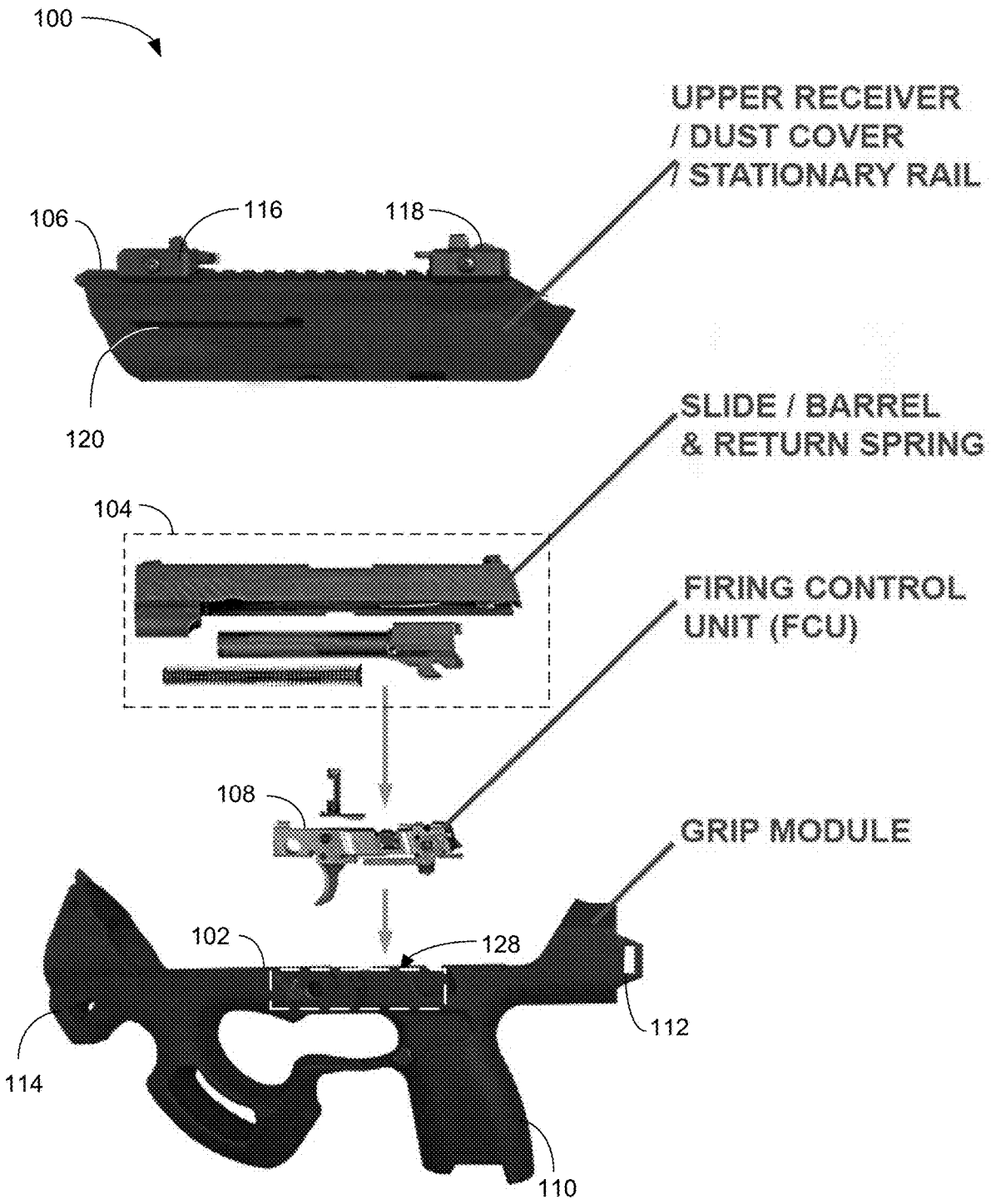
FIG. 1 is a diagram illustrating a grip module and FCU in accordance with one embodiment of the present invention.

Exemplary embodiment(s) of the present invention is described herein in the context of a method, system and apparatus of modifying a firearm using a grip module and FCU.

Those of ordinary skills in the art will realize that the following detailed description of the exemplary embodiment (s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the presently claimed invention discloses a bullpup-shaped rifle or assault rifle ("AR") using the grip module. The bullpup-shaped rifle ("BSR") or assault rifle ("AR") is able to expel an object such as a bullet. In some embodiments, the BSR includes a firing control unit ("FCU"), grip module, bullpup rear attachment, and bolt and barrel assembly. The FCU is a serialized trigger mechanism capable of initiating launching a directional object when a trigger of the FCU is pulled. The grip module which contains a grip, FCU housing, and rear stabilizing connector, wherein the FCU housing is configured to house a removable FCU. The bullpup rear attachment which is coupled to the rear stabilizing connector for enhancing stability is configured to have a magazine port for receiving a magazine. The bolt and barrel assembly which is situated above the magazine port inside of the bullpup rear attachment behind the FCU facilitates the firing of the object. In one aspect, the BSR also includes an upper receiver configured to couple to the grip module for enclosing the FCU and the bolt and barrel assembly between the upper receiver and the grip module.

FIG. 1 is a diagram 100 illustrating a grip module and FCU in accordance with one embodiment of the present invention. Diagram 100, in some embodiments, includes a grip module 102, FCU 108, internal components 104, and upper receiver 106. Internal components 104 includes, but not limited to, a slide, a barrel, a barrel block, a bolt, and/or return spring. Grip module 102, in one example, can also be referred to as bottom receiver or lower receiver. It should be noted that the underlying concept of the exemplary embodiment(s) of the present invention would not change if one or more components (or elements) were added to or removed from diagram 100.

Grip module 102, in some embodiments, includes a handle or grip 110, an FCU housing 128, a rear stabilizing connector 112, and a trunnion 114. Grip 110 can be resized to better accommodate smaller or larger hands of a user. In one example, grip 110 is configured to be hollow capable of receiving a magazine of ammunition. It should be noted that grip 110 can be designed to a grip similar to a particular model of firearm. FCU housing 128, in some embodiments, is configured to FCU or FCU module 108. In an alternative embodiment, grip module 102 is configured to accept any one or more of the upper components of the original firearm (such as the barrel, barrel block, bolt, strike, and/or slide) in addition to FCU module 108. For the forgoing discussion, the terms "FCU" and "FCU module" are referring similar component(s) and they can be used interchangeably.

Rear stabilizing connector 112, in some embodiments, is configured to accommodate an arm brace, buttstock, or cheek rest attachment. For example, grip module 102 can be designed as a Short Barrel Rifle ("SBR"), which would convert a pistol or rifle to an SBR or act as an alternative grip module for an existing SBR. In one aspect, the rear attachment, such as an arm brace, cheek rest, or buttstock, is configured to be optionally added or removed from rear stabilizing connector 112. In another aspect, the rear attachment such as buttstock could be designed to be stationary or collapsing, and could also be designed to incorporate a spare magazine holster. A function of the rear attachment such as an arm brace or buttstock is to provide stability of the modified assembly during a firing operation.

Upper receiver 106, in some embodiments, is configured to take the form of an upper receiver with the option of a mounting point, a dust cover, which could use the upper components from the original firearm or new components, a trunnion, or a stationary rail. For example, upper receiver 106 contains scope latches 116-118 which will be used to secure a scope for aiming. Upper receiver 106, in one example, includes an opening for the movement of a bolt and bolt carrier associated with firearm cocking as indicated by numeral 120. Upper receiver 106 further includes a serial displaying window which will be used to show the original serial number of FCU when FCU is inserted into FCU housing 128.

An advantage of employing grip module is that it provides accessory options, capability enhancements, customization options, and other options not available on the otherwise available firearms.

Figure 2A:
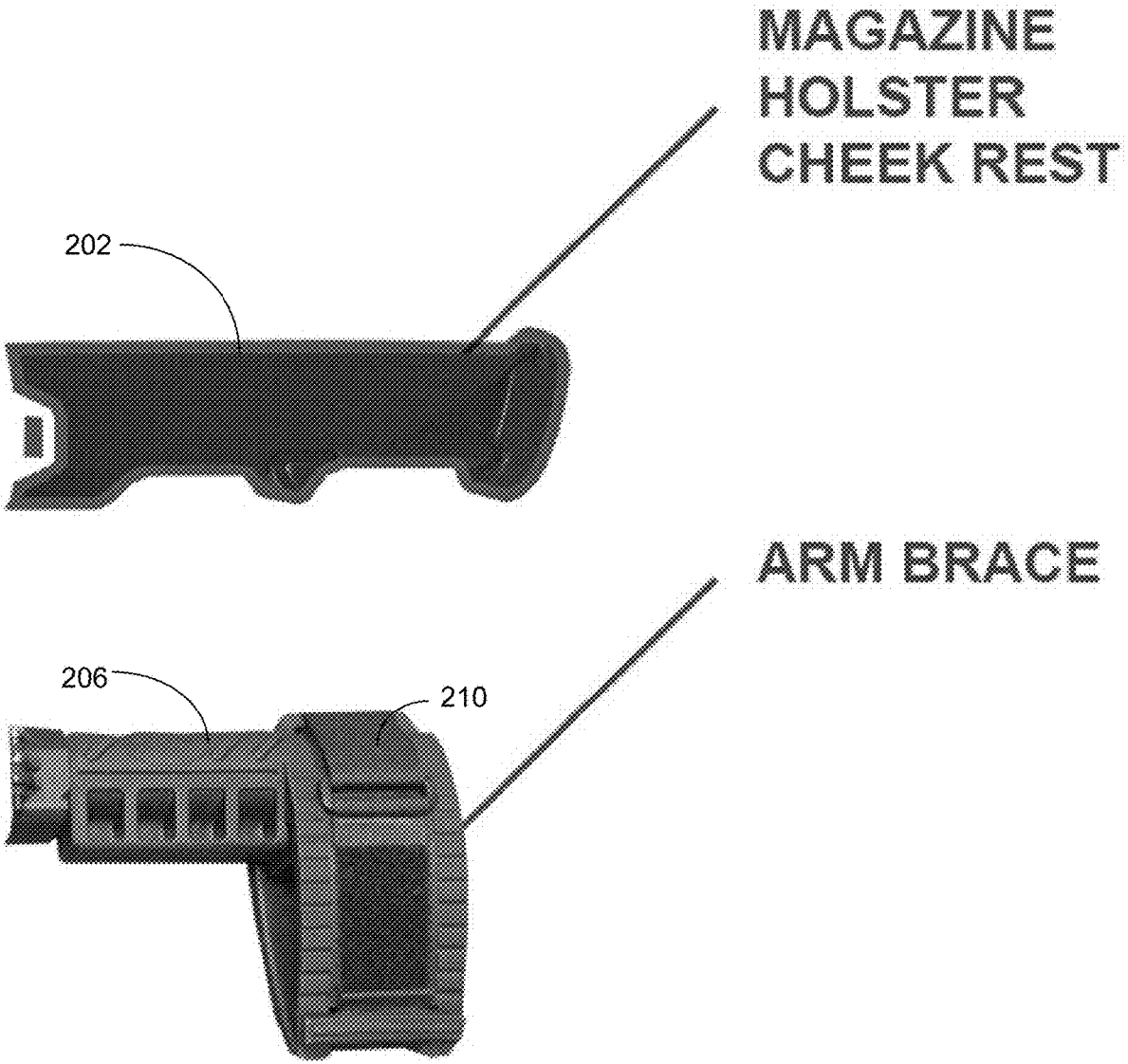
FIGS. 2A-B are diagrams illustrating rear attachments to the grip module in accordance with one embodiment of the present invention.

FIG. 2A illustrates an arm brace 206 and a magazine holster cheek rest 202 capable of being attached to the rear stabilizing connector in accordance with one embodiment of the present invention. Arm brace 206, in one example, can be connected to the rear stabilizing connector of the grip module for providing stability. A strip 210 which can be part of arm brace 206 is used to provide additional stability support. Cheek rest 202, in some embodiments, can be a magazine holster for carrying additional ammunition. Alternatively, cheek rest 202 can be a solid piece for cheek resting. It should be noted that the underlying concept of the exemplary embodiment(s) of the present invention would not change if one or more components (or elements) were added to or removed from diagrams 202 or 206.

Figure 2B:
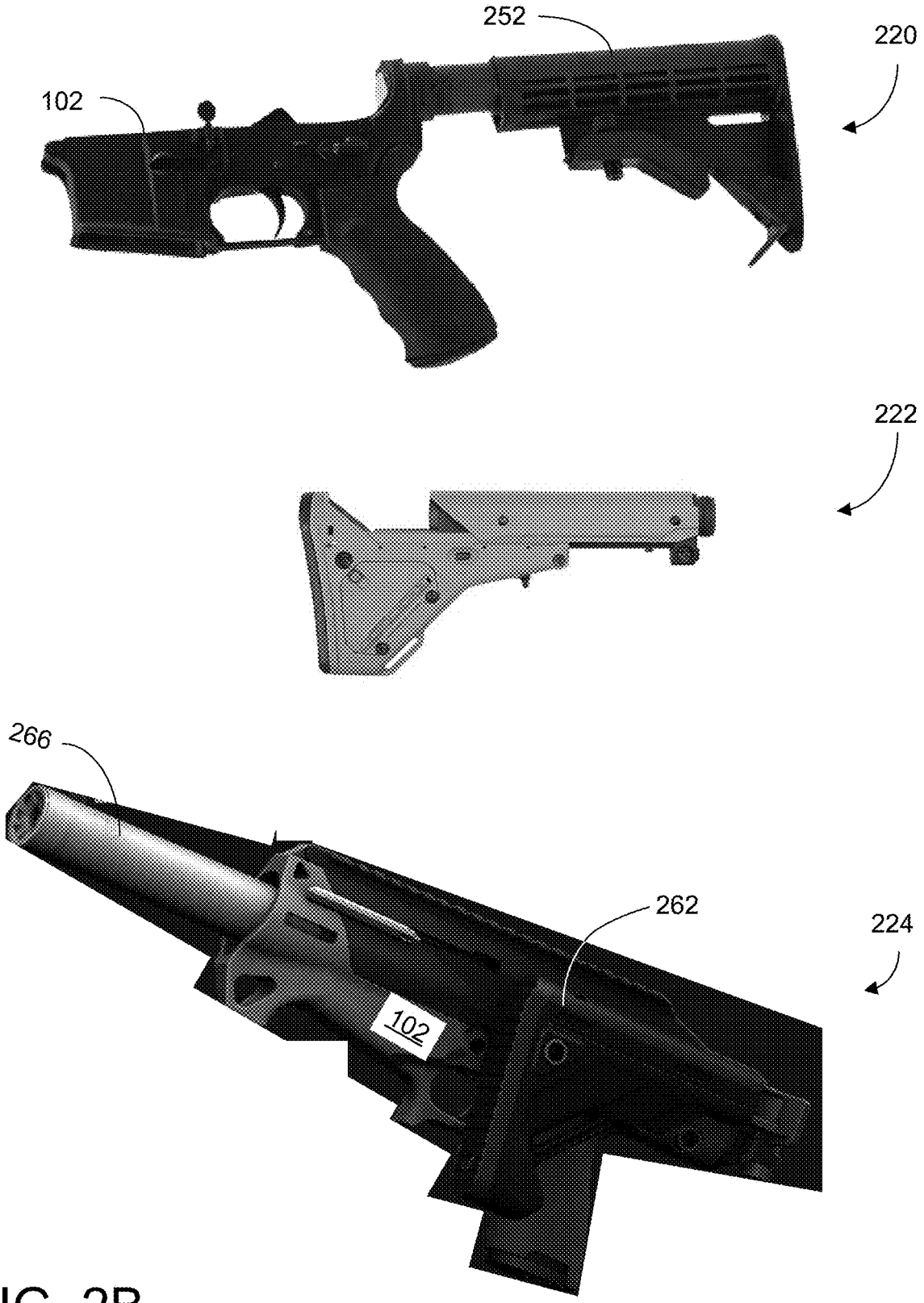

FIG. 2B illustrates diagrams 220-224 showing rear attachments capable of being attached to the grip module in accordance with one embodiment of the present invention. Diagram 220 illustrates a buttstock 252 attached to grip module 102 or lower receiver. In one aspect, buttstock 252 is removable but it is stationary when it is connected. Diagram 222 shows an alternative type of buttstock which can be similar to buttstock 252. Diagram 224 illustrates a modified assembly containing barrel 266, grip module 102, and buttstock 262. In one aspect, buttstock 262 is collapsible by holding buttstock 262 in 180 degrees. It should be noted that the underlying concept of the exemplary embodiment(s)

of the present invention would not change if one or more components (or elements) were added to or removed from diagrams 220-224.

Figure 3:
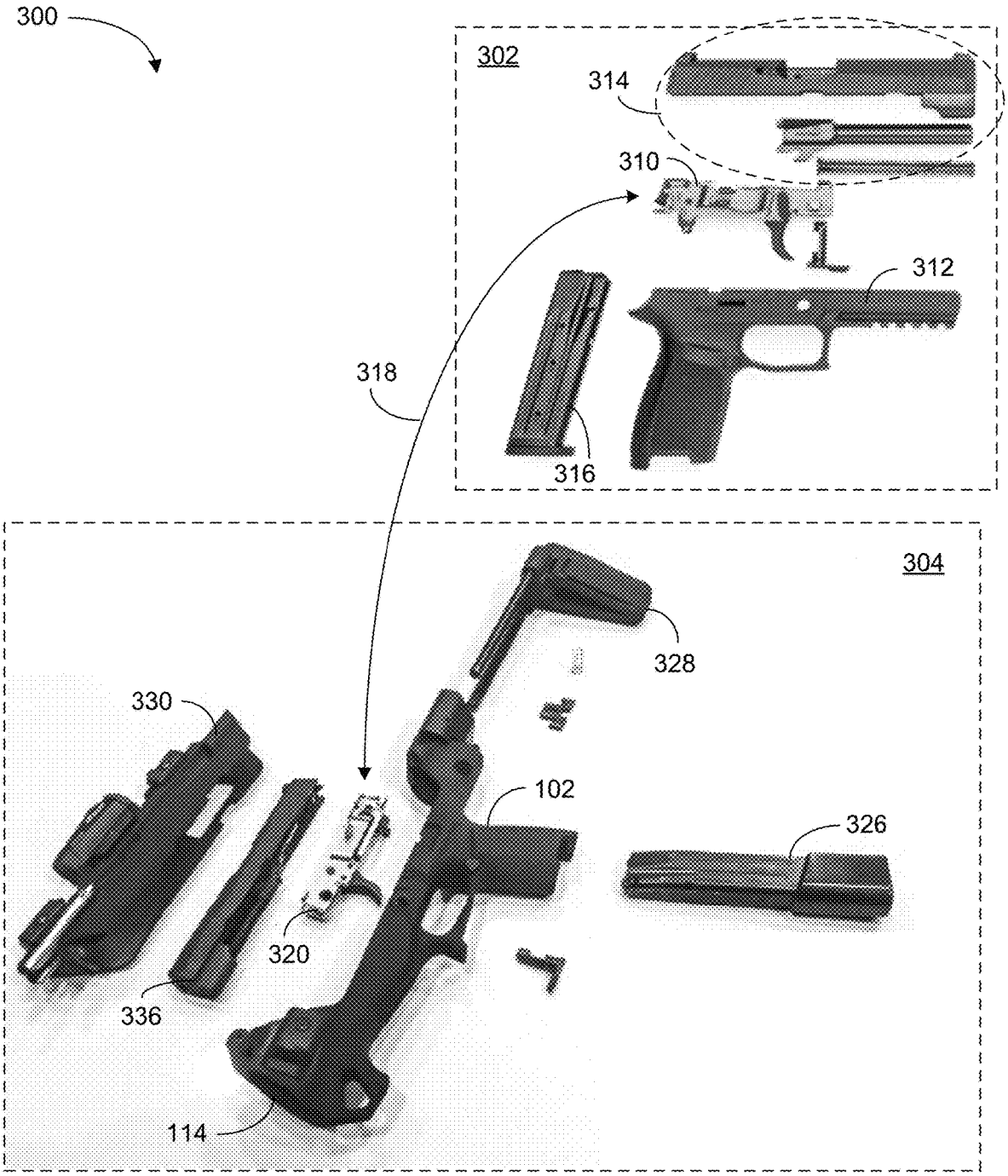
FIG. 3 is a diagram illustrating a conversion process using the same FCU with different bodies in accordance with one embodiment of the present invention.

FIG. 3 is a diagram 300 illustrating a conversion process using the same FCU with different bodies in accordance with one embodiment of the present invention. Diagram 300 includes a pistol 302 and a modified assembly 304 which is configured to resemble as an MP9 (maschinenpistol 9 mm) like submachine gun. In some embodiments, modified assembly 304 is configured to incorporate usage of FCU 320 which is the same or substantially the same as FCU 310 used in pistol 302. It should be noted that the underlying concept of the exemplary embodiment(s) of the present invention would not change if one or more components (or elements) were added to or removed from diagram 300.

Pistol 302, in some embodiments, includes FCU 310, pistol receiver 312, magazine 316, and internal components 314 which includes a slide, barrel, and return spring. Pistol 302, in one example, can be the Glock model 17 which can be easily disassembled to separate FCU 310 from pistol 302. FCU 310, in one embodiment, can be refitted into modified assembly 304 as indicated by numeral 318.

Modified assembly 304, in one embodiment, includes a grip module 102, magazine 326, internal components 336, upper receiver 330, and FCU 320 which is similar or the same as FCU 310. Internal components 336 includes, but not limited to, a slide, a barrel, a barrel block, a bolt, and/or return spring. Grip module includes a rear stabilizing connector which is used to couple to a buttstock 328. It should be noted that when modified assembly 304 is assembled with FCU 320, the assembly should resemble a semiautomatic machine gun such as MP9.

An advantage of using a grip module is that it facilitates a conversion from a pistol like firearm to a rifle or machine gun like firearm using similar FCU modules.

Figure 4:
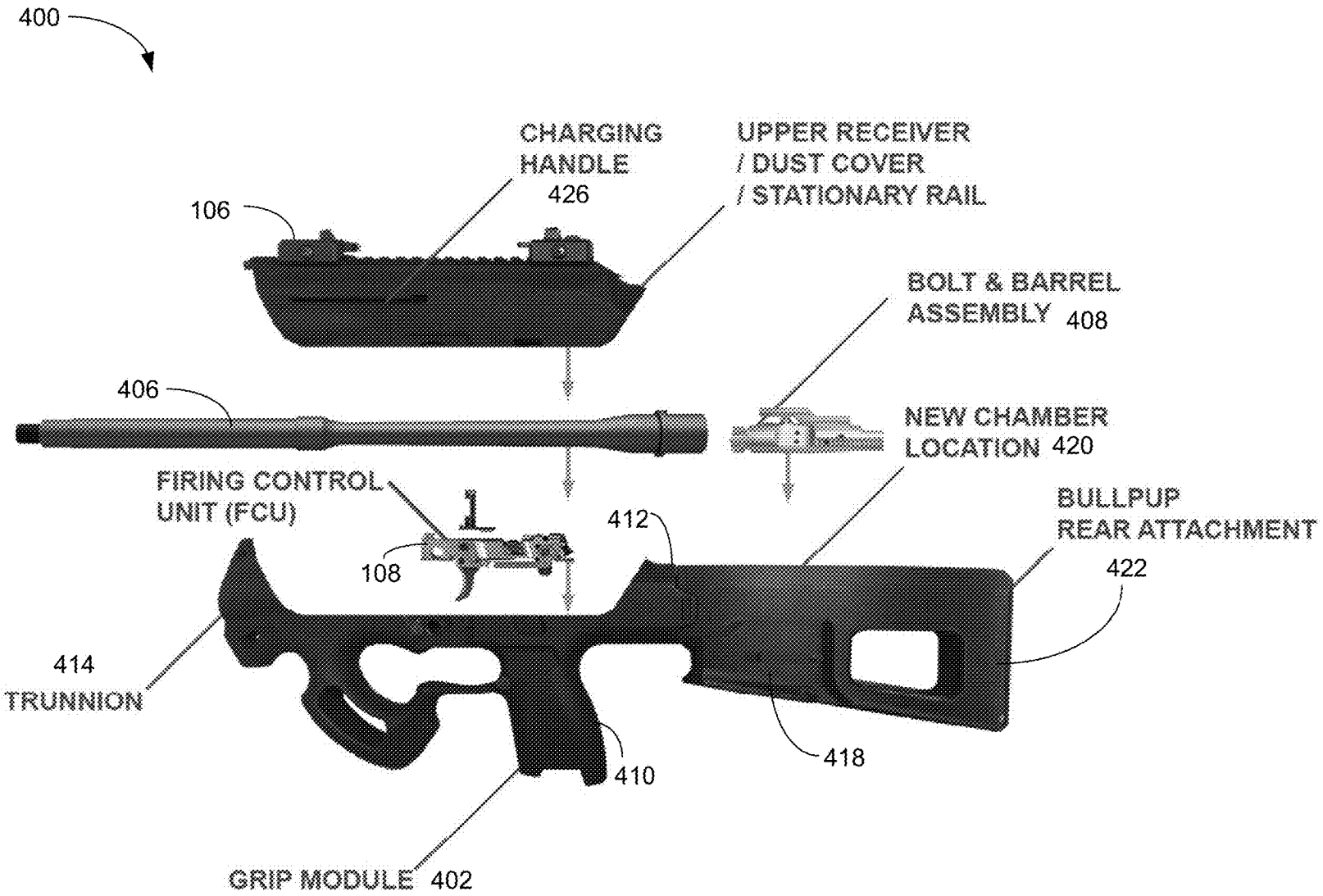
FIG. 4 is a diagram illustrating a bullpup-shaped rifle ("BSR") using the grip module in accordance with one embodiment of the present invention.

FIG. 4 is a diagram 400 illustrating a bullpup-shaped rifle ("BSR") using the grip module in accordance with one embodiment of the present invention. Diagram 400 includes a grip module 402, FCU 108, upper receiver 106, bolt and barrel assembly 408, and barrel 406. Grip module 402, in some embodiments, includes a BSR buttstock 422. It should be noted that the underlying concept of the exemplary embodiment(s) of the present invention would not change if one or more components (or elements) were added to or removed from diagram 400.

Grip module 402, in one aspect, includes a grip or handle 410, FCU housing or cavity for housing FCU 108, trunnion 414, and rear stabilizing connector 412. Grip module 402, in some embodiments, is structured to include at least a portion of lower receiver for a pistol, Small Barrel Rifle ("SBR"), and/or self-loading semiautomatic rifle. It should be noted that the grip module such as grip module 402 is designed to accept an FCU module such as FCU 108 in such a way that the ammunition loading port(s) and/or ammunition type(s) can be deviated from the originally designated port(s) associated with the FCU when it is manufactured.

An SBR, or short barrel rifle is a type of rifle with relatively short barrel(s). For example, an SBR may have a barrel shorter than 16" or smaller than 26" overall length of SBR. Another type of firearm that is similar to SBR is bullpup rifle or Short Barrel Shotgun both of which have relatively short barrels.

The BSR, in one aspect, includes an FCU 108, grip module 402, bullpup rear attachment 422, and bolt and barrel assembly 408, and is capable of firing an object such as a bullet. FCU 108 is configured to be a serialized trigger mechanism capable of initiating launching a directional object when a trigger is pulled. Grip module 402 further contains a grip 410, FCU housing, and rear stabilizing connector 412, wherein the FCU housing is configured to house a removable FCU such as FCU 108.

Bullpup rear attachment 422, coupled to the rear stabilizing connector, is used to enhance overall stability of the BSR. In one example, bullpup rear attachment 422 is configured to have a magazine port 418 for receiving a magazine. The magazine, in one example, is a vessel or receptacle for housing ammunition. Bolt and barrel assembly 408 is situated above magazine port 418 inside attachment 422 for facilitating firing of the object. In one example, bolt and barrel assembly 408 is physically situated behind FCU 108.

The BSR further includes an upper receiver configured to couple to grip module 402 capable of enclosing FCU 108 as well as assembly 408 between upper receiver 106 and grip module 402. Upper receiver 106 includes scope latches 106 capable of receiving a scope for target aiming and a charging handle 426. FCU 108 contains an original serial number for identifying FCU and/or firearm. Grip module 402 contains a serial number window which is located in such a way that when FCU 108 is inserted in the FCU housing of grip module 402, the original serial number of FCU 108 displays through the serial number window. Grip module 402, in some embodiments, can be fabricated by one of aluminum, zinc, alloy, composite materials, and pressure resistance plastics. Grip module 402 includes a trunnion 414, barrel block, or receiver which are used to receive or attach a barrel 406 coupling to grip module 402.

An advantage of using grip module 402 is that it enable to a user to convert from a pistol to a semiautomatic machine gun or rifle or vice versa.

Figure 5:
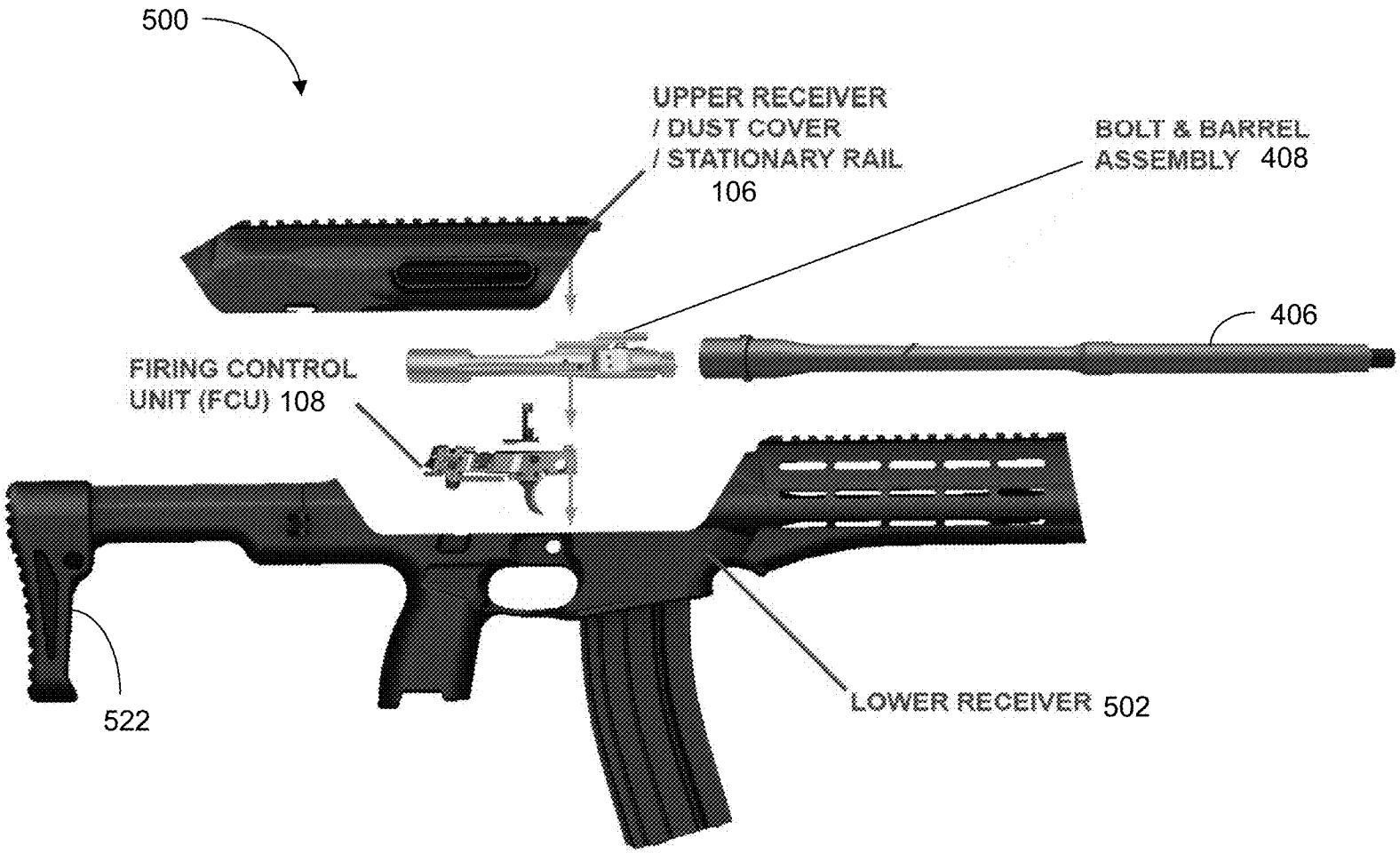
FIG. 5 is a diagram illustrating a carbine-like rifle using the grip module in accordance with one embodiment of the present invention.

FIG. 5 is a diagram 500 illustrating a carbine-like rifle using a grip module in accordance with one embodiment of the present invention. Diagram 500 includes grip module 502 and buttstock 522. In one aspect, bolt and barrel assembly 408 is situated in the vicinity of FCU 108. A carbine rifle is a relatively long gun with a medium range barrel which is generally shorter than a rifle. A carbine rifle, such as M4 carbine, is a version of rifle capable of firing rifle ammunition as well as pistol ammunition. It should be noted that the underlying concept of the exemplary embodiment(s) of the present invention would not change if one or more components (or elements) were added to or removed from diagram 500

In operation, grip module or lower receiver 502 is configured to house FCU 108 as well as bolt and barrel assembly 408. Barrel 406 can be coupled to bolt & barrel assembly 406 using either a bolt block, lower receiver, and/or assembly 408. Upper receiver, which can perform a function of dusk cover and/or stationary rail, is coupled to lower receiver 502. A benefit of using the embodiment of grip module or lower receiver 502 is that it facilitates converting a hand gun to a carbine-like rifle using some components of the hand gun such as FCU.

Figure 6:
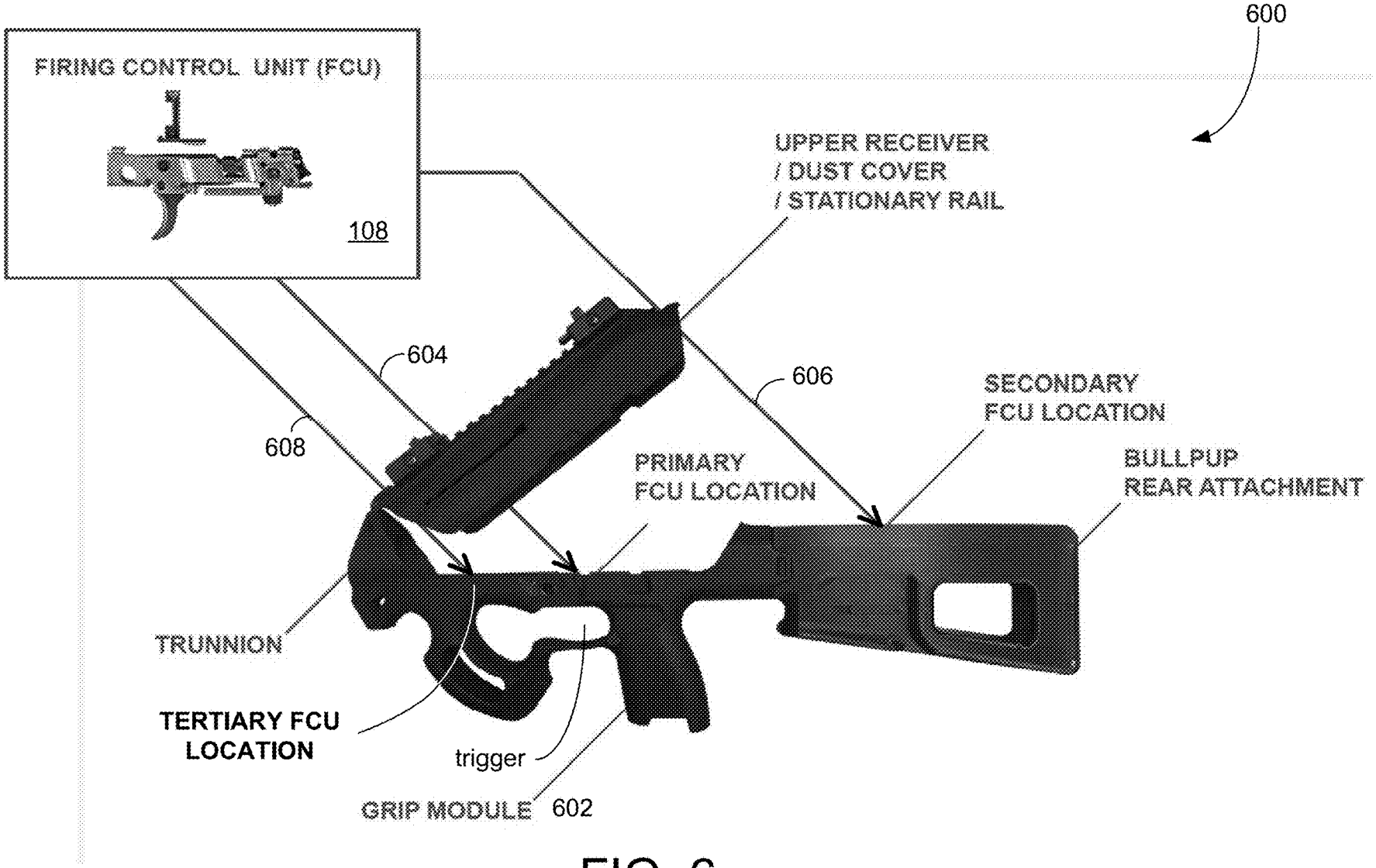
FIG. 6 is a diagram illustrating a grip module capable of housing multiple FCUs in accordance with one embodiment of the present invention.

FIG. 6 is a diagram 600 illustrating a grip module capable of housing one or more FCUs in accordance with one embodiment of the present invention. Diagram 600 illustrates a semiautomatic firearm assembly able to expel ammunition. The firearm assembly includes FCU 108, grip module 602, upper receiver, and bullpup rear attachment. FCU 108, in some embodiments, controls firing sequence. Grip module 602 contains a grip, first FCU housing or primary FCU location referenced by numeral 604, second FCU housing or secondary FCU location referenced by numeral 606, third FCU housing or tertiary FCU location referenced by numeral 608, and rear stabilizing connector. The rear stabilizing connector is used to couple to a bullpup rear attachment or buttstock.

First FCU housing or primary FCU location is situated above the trigger, and second FCU housing or secondary FCU location is situated in behind of the trigger. It should be noted that barrel of a gun is referred as the front of gun and buttstock is referred to as the back of the gun. Also, the direct against the gravity is referred to as up or above and the direct with the gravity is referred to as low or below. Third FCU housing or tertiary FCU location is situated in the front of the trigger, wherein the first, second, and third FCU housings are capable of housing one or more FCU modules which can be used to facilitate launching one or more types of ammunition substantially the same time.

In some embodiments, the primary FCU location or primary FCU module location is configured to be above the trigger, and the secondary FCU location or FCU module location is situated to be forward of the trigger. The tertiary FCU module location or FCU location is rearward of the trigger as indicated by numeral 608. In some aspects, grip module 602 is designed to accept an FCU module at any two of the primary, secondary, and tertiary FCU module locations. Grip module 602, in one embodiment, utilizes a single external trigger to actuate one or more FCUs situated in the FCU module locations referenced by numbers 604-608. Grip module 602, in an alternative embodiment, utilizes a single external trigger to actuate three FCUs situated in the FCU module locations referenced by numbers 604-608.

Alternatively, different FCU can be configured to control firing different caliber of bullets. For example, the first FCU may be used to fire 50 caliber ("50 cal") while the second FUC may be used to control filing of 5.56 millimeters ("mm"). It should be noted that Caliber (Cal) is the diameter of a firearm's bore. For example, "50 cal" is a .50 inch caliber, or a half-inch in diameter. Also, 9 mm, 5.56 mm, 7.62 mm are usually referring to the diameter of the bore and bullet that goes through it.

An advantage of using more than one FCU modules or using one FCU module control multiple types of ammunition is to allow a user to launch a grenade, missile, and/or drone while keeping firing of bullets.

Figure 7:
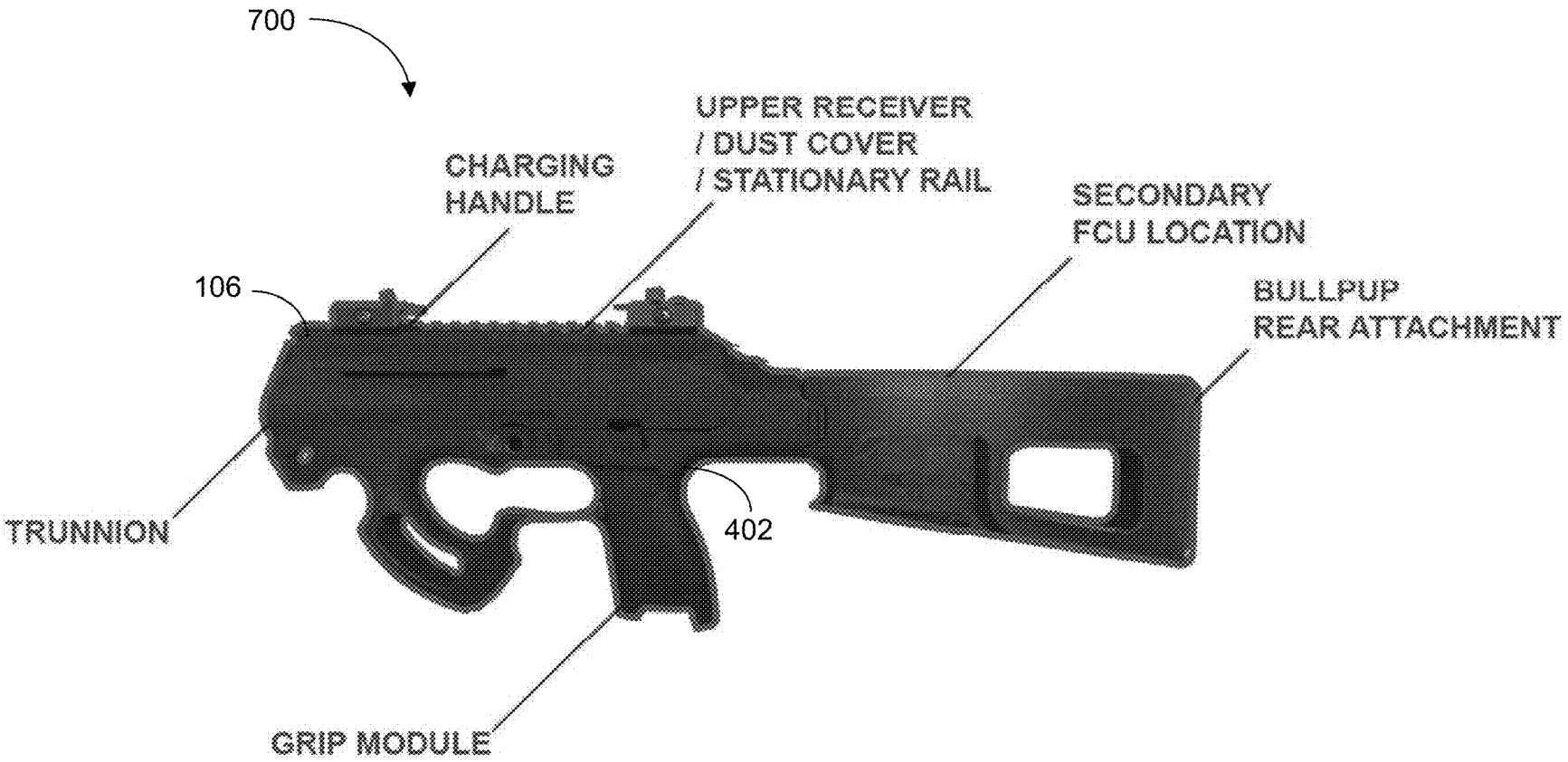
FIG. 7 is a diagram illustrating a modified assembly having a grip module and upper receiver in accordance with one embodiment of the present invention.

FIG. 7 is a diagram 700 illustrating a modified assembly having a grip module and upper receiver in accordance with one embodiment of the present invention. Diagram 700, in one embodiment, is similar to diagram 600 except that the upper receiver and lower receiver (or grip module 402) are in closed formation. In one aspect, the modified assembly can be used to convert a pistol to a bullpup-like rifle using some of the pistol's components such as the FCU or vice versa.

Figure 8:
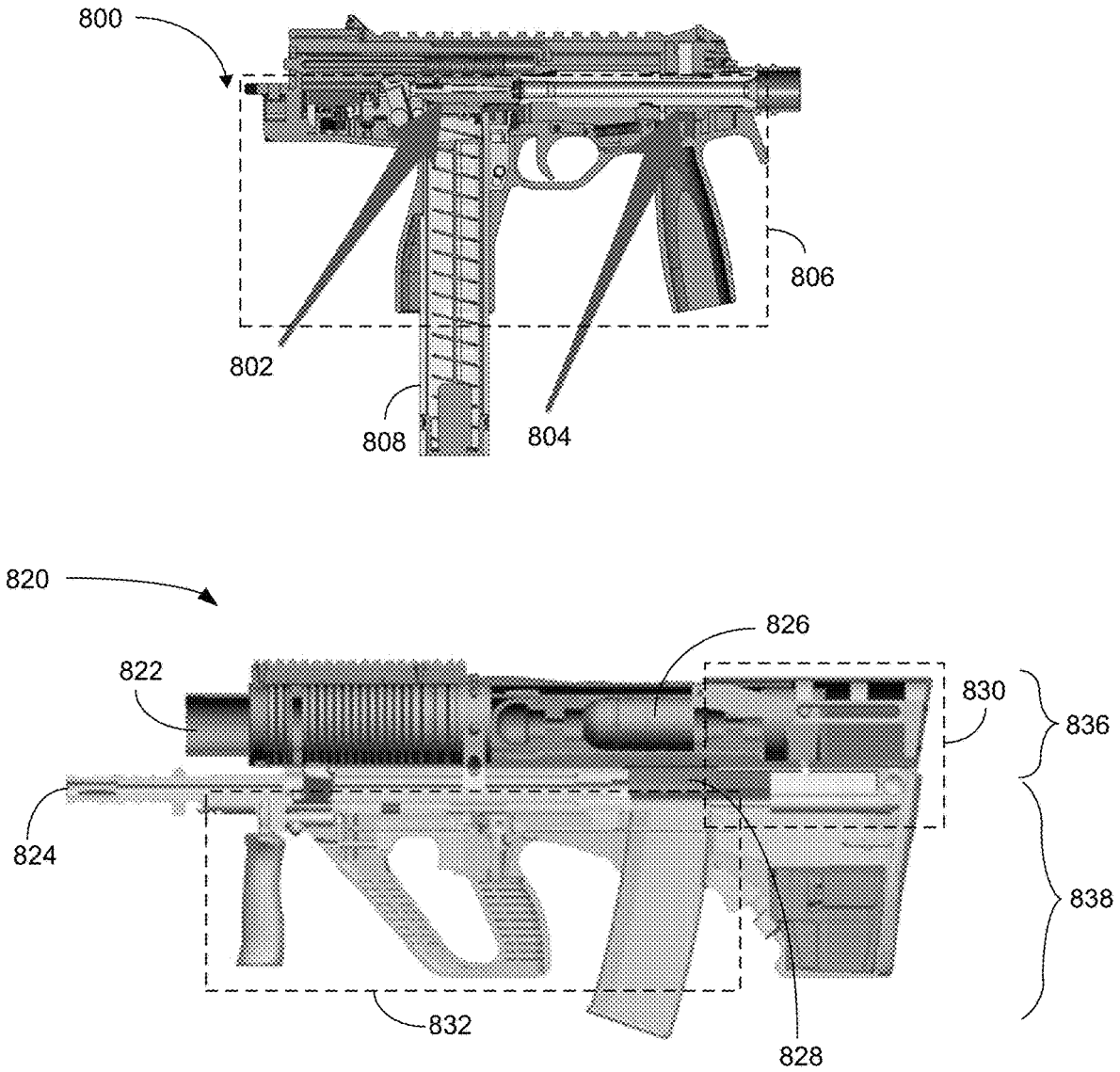
FIG. 8 is a diagram illustrating cut-open illustrations of guns showing internal components in accordance with one embodiment of the present invention.

FIG. 8 is a diagram illustrating cut-open illustrations of an MP9 like gun 800 and bullpup rifle with grenade launcher (or semiautomatic machine gun) 820 showing internal components in accordance with one embodiment of the present invention. MP9 like gun 800 illustrates a bolt 802 and a barrel block 804 wherein barrel block 804 is used to anchor a barrel, not shown in FIG. 8. In some embodiments, the grip module such as grip module 806 is designed to accept variable sized barrels for different sized ammunition. Grip module 806 containing a grip is capable of receiving a magazine 808 to facilitate burst firing of bullets.

Machine gun 820 includes a gun portion 838 and a grenade launcher 836 wherein gun portion 838 includes a grip module 832, barrel 824, and bullet(s) 828. Grenade launcher 826 includes grenade(s) 826 and launcher barrel 822. In some aspects, FCU(s) 830 can be in gun portion 838, launcher 836, or both depending on the configuration of FCU(s). For example, gun 820 includes a bullpup rifle portion 838 containing barrel 824 and grenade launcher 838 with a barrel 822. It should be noted that grenade launcher 838 can launch grenades, drones, missiles, and/or cannons.

Grip module 832, in one example, is designed to accept barrels 822-824 for various sized ammunition such as grenade 826 and bullet 828. In one embodiment, grip module 832 accepts a barrel at the Primary, Secondary, or Tertiary FCU module location as well as two or three barrels simultaneously. Alternatively, grip module 806 or 832 is designed to convert the slide or bolt carrier of the original firearm into a bolt carrier or slide. Grip module 832 or 806 is designed to use the FCU module as a triggering device that activates a firing apparatus. It should be noted that grip module such as grip module 832 is capable of permitting the FCU module such as FCU 830 to activate one or more types of ammunition substantially concurrent.

An advantage of using the grip module is to increase the versatility of firearm using a portion of existing components such as FCU(s).

In some embodiments, gun 820 includes a semiautomatic firearm assembly able to expel or fire bullets and/or grenades. Gun 820 includes an FCU module 830 and grip module 832. FCU module 830 is configured to be a serialized trigger mechanism capable of initiating launching one or more directional objects such as bullets and grenade when a trigger is pulled. FCU module 830, in one embodiment, includes a single FCU configured to control both bullet and grenade firings. Alternatively, FCU module 830 includes two FCUs wherein one FCU is used to fire bullets 828 while another FCU is used to launch grenades 826. It should be noted that additional FCUs may be used to control additional types of ammunition.

Gun 820 further includes an upper receiver configured to couple to the grip module such as grip module 832 for enclosing the FCU, bolt and barrel assembly between the upper receiver and the grip module. Note that the FCU situated in the grip module is able to select one of multiple types of ammunition. In some embodiments, the FCU situated in the first FCU housing is actuated via a triggering system for firing a bullet while the FCU situated in the second FCU housing is actuated via the triggering system for launching a grenade.

Figure 9:
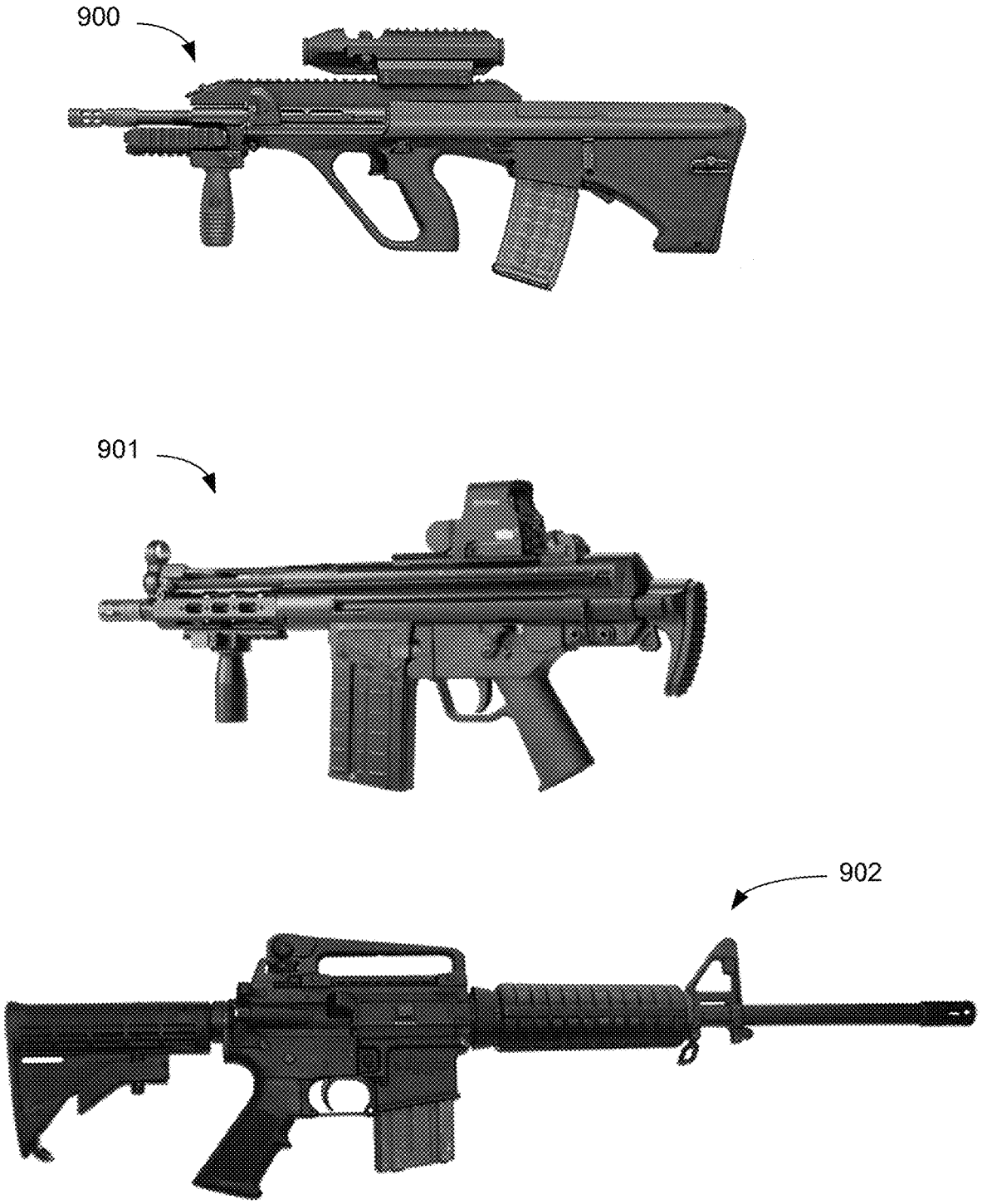
FIGS. 9-10 are diagrams illustrating exemplary firearms capable of using grip modules in accordance with one embodiment of the present invention.
Figure 10:
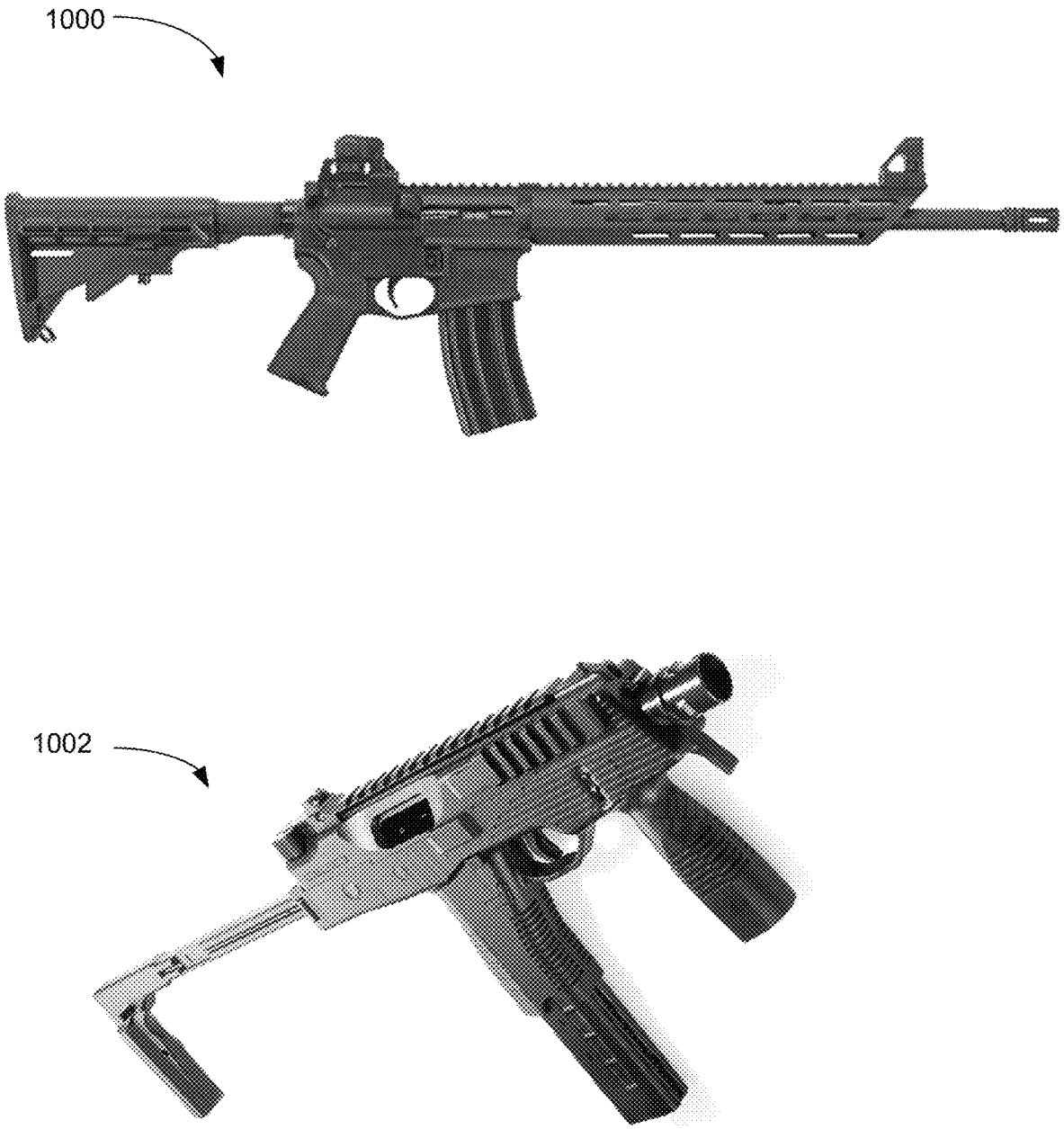

FIGS. 9-10 are diagrams 900-1002 illustrating exemplary firearms capable of using grip modules in accordance with one embodiment of the present invention. It should be noted that the illustrated firearms are self-loading rifles or machine guns. Self-loading or automatic loading semiautomatic firearm can be referred to as automatic loading of ammunition in response to the prior firing. It should be noted that the underlying concept of the exemplary embodiment(s) of the present invention would not change if one or more guns (or elements) were added to or removed from diagrams 900-1002.

Diagram 900 illustrate a bullpup or bullpup like rifle capable of firing ammunition continuously using self-loading mechanism. Embodiments of grip module can be employed to convert between a hand gun and a bullpup like rifle using certain shared components such as FCU module (s). A benefit of using the embodiment(s) of the grip module is to enable a user to interchange certain components such FCU module(s) between pistols, rifles, and machine guns.

Diagram 901 illustrate a small barrel rifle ("SBR") or SBR like rifle capable of firing ammunition continuously using self-loading mechanism. Embodiments of grip module can be employed to convert between a hand gun and a SBR like rifle using certain shared components such as FCU module(s). A benefit of using the embodiment(s) of the grip module is to enable a user to interchange certain components such FCU module(s) between pistols, rifles, and machine guns.

Diagram 902 illustrate an assault rifle ("AR") such as AR 15 like rifle capable of firing ammunition continuously using self-loading mechanism. Embodiments of grip module can be employed to convert between a hand gun and an AR 15 like rifle using certain shared components such as FCU module(s). A benefit of using the embodiment(s) of the grip module is to enable a user to interchange certain components such FCU module(s) between pistols, rifles, and machine guns.

Diagram 1000 illustrate a carbine rifle or carbine like rifle capable of firing ammunition continuously using self-loading mechanism. Embodiments of grip module can be employed to convert between a hand gun and a carbine like rifle using certain shared components such as FCU module (s). A benefit of using the embodiment(s) of the grip module is to enable a user to interchange certain components such FCU module(s) between pistols, rifles, and machine guns.

Diagram 1002 illustrate MP9 or MP9 like gun capable of firing ammunition continuously using self-loading mechanism. Embodiments of grip module can be employed to convert between a hand gun and an MP9 like rifle using certain shared components such as FCU module(s). A benefit of using the embodiment(s) of the grip module is to enable a user to interchange certain components such FCU module(s) between pistols, rifles, and machine guns.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A bullpup-shaped rifle ("BSR") able to expel an object comprising:

a firing control unit ("FCU"), which is originally configured to be a serialized trigger mechanism via a striker for a pistol, configured to be removable from the pistol, able to facilitate launching a directional object when a trigger of the FCU is pulled;

a grip module having a shape resembling a portion of a bullpup rifle containing a grip, an FCU housing, and a rear stabilizing connector, wherein the FCU housing is configured to a predefined dimension for refitting the FCU which is disassembled from the pistol for firing control, wherein the grip is configured to be hollow for receipt of a magazine and able to guide objects inside the magazine to the serialized trigger mechanism for firing;

a bullpup rear attachment, coupled to the rear stabilizing connector for enhancing stability of the BSR, configured to have a magazine port for receiving a magazine; and a bolt and barrel assembly containing a barrel and a bolt situated above the magazine port inside of the bullpup rear attachment behind the FCU for facilitating firing of the object.

2. The BSR of claim 1, further comprising an upper receiver configured to couple to the grip module for enclosing the FCU and the bolt and barrel assembly between the upper receiver and the grip module.

3. The BSR of claim 2, wherein the upper receiver includes scope latches capable of receiving a scope for target aiming.

4. The BSR of claim 1, wherein the FCU which is configured to control firing contains an original serial number for identification purposes.

5. The BSR of claim 4, wherein the grip module contains a serial number window which is located in such a way that when the FCU is inserted in the FCU housing of the grip module, the original serial number shows through the serial number window.

6. The BSR of claim 1, wherein the grip module is fabricated by one of aluminum, zinc, alloy, composite materials, and pressure resistance plastics.

7. The BSR of claim 1, wherein the grip module includes a trunnion and a barrel block couple to a receiver for coupling to a barrel.

8. The BSR of claim 1, wherein the barrel is coupled to the grip module via a trunnion.

9. The BSR of claim 1, wherein the object is ammunition.

10. The BSR of claim 9, wherein the ammunition is bullets.

11. A semiautomatic bullpup rifle capable of firing bullets comprising the BSR of claim 1.

12. A rifle having a magazine behind a trigger able to fire ammunition comprising:

a firing control unit ("FCU") originally configured to be a serialized trigger mechanism via a striker for a handgun, wherein the FCU is configured to be removable from the handgun and able to facilitate launching a directional object when a trigger of the FCU is pulled;

a grip module having a shape resembling a grip module of a carbine rifle containing a grip, an FCU housing, and a rear stabilizing connector, wherein the FCU housing is configured to a predefined dimension for refitting the FCU to the grip module for its launching mechanism, wherein the grip is configured to be hollow for receipt of a magazine and able to guide objects inside the magazine to the serialized trigger mechanism for firing;

a carbine rear attachment, coupled to the rear stabilizing connector for enhancing stability, configured to have a magazine port for receiving a magazine; and a bolt and barrel assembly containing a barrel and a bolt situated above the FCU inside of the grip module for facilitating firing of the object.

13. The rifle of claim 12, further comprising an upper receiver configured to couple to the grip module for enclosing the FCU and the bolt and barrel assembly between the upper receiver and the grip module.

14. The rifle of claim 13, wherein the upper receiver includes scope latches capable of receiving a scope for target aiming.

15. The rifle of claim 12, wherein the FCU contains an original serial number for identification purposes.

16. The rifle of claim 15, wherein the grip module contains a serial number window which is located in such a way that when the FCU is inserted in the FCU housing of the grip module, the original serial number shows through the serial number window.

17. The rifle of claim 12, wherein the grip module is fabricated by one of aluminum, zinc, alloy, composite materials, and pressure resistance plastics.

18. The rifle of claim 12, wherein the grip module includes a trunnion and a barrel block for coupling to a barrel.

19. The rifle of claim 12, further comprising a barrel coupled to the grip module.

20. The rifle of claim 12, wherein the ammunition is bullets.

21. A gun resembling an MP9 rifle able to fire ammunition comprising:

a firing control unit ("FCU") originally fabricated for a handgun as a serialized trigger mechanism for a pistol, wherein the FCU is separated from the pistol for facilitating launching a directional object when a trigger of the FCU is pulled;

a grip module having a shape resembling a grip module of an MP9 containing a grip, an FCU housing, and a rear stabilizing connector, wherein the grip is configured to be hollow for receipt of a magazine and able to guide objects inside the magazine to the serialized trigger mechanism for firing, wherein the FCU housing is configured to refit the FCU which is separated from the pistol for its launching mechanism, wherein the grip module contains a serial number window which is located in such a way that when the FCU is inserted in the FCU housing, an original serial number of the FCU shows through the serial number window; and an MP9 rear attachment coupled to the rear stabilizing connector for enhancing stability of MP9 rifle.

22. The rifle of claim 21, further comprising an upper receiver configured to couple to the grip module for enclosing the FCU and the bolt and barrel assembly between the upper receiver and the grip module.

23. The rifle of claim 22, wherein the upper receiver includes scope latches capable of receiving a scope for target aiming.

24. The rifle of claim 21, wherein the FCU contains an original serial number for identification purposes.

25. The rifle of claim 21, wherein the grip module is fabricated by one of aluminum, zinc, alloy, composite materials, and pressure resistance plastics.

26. The rifle of claim 21, wherein the grip module includes a trunnion and a barrel block for coupling to a barrel.

27. The rifle of claim 21, further comprising a barrel coupled to the grip module.

* * * * *